US006135836A

United States Patent [19]

Rhynsburger

[11] Patent Number: 6,135,836

[45] Date of Patent: Oct. 24, 2000

[54] WINDSURFING BOARD FIN PROTECTOR

[76] Inventor: Rennie L. Rhynsburger, 1475 W. 300 South, Salt Lake City, Utah 84101

[21] Appl. No.: 09/379,259

[22] Filed: Aug. 23, 1999

[51] Int. Cl.[7] ..... B63B 35/79

[52] U.S. Cl. ..... 441/74

[58] Field of Search ..... 441/74, 68, 79; 114/361; 244/3, 24

[56] References Cited

U.S. PATENT DOCUMENTS

| | | | |
|---|---|---|---|
| D. 292,752 | 11/1987 | Reinhardt | D3/102 |
| 4,320,569 | 3/1982 | Todd, Sr. | 29/469.5 |
| 4,759,483 | 7/1988 | Willoughby | 224/235 |
| 4,792,316 | 12/1988 | Skedeleski et al. | 441/74 |
| 5,009,348 | 4/1991 | Derkatz | 224/232 |
| 5,474,256 | 12/1995 | Garner | 244/3.24 |

OTHER PUBLICATIONS

The House 1999 mail order catalog, p. 24, showing Finshield fin protector, The House. St. Paul, Minnesota.

Photographs of DaKine Hawaii fin protector.

*Primary Examiner*—S. Joseph Morano
*Assistant Examiner*—Patrick Craig Muldoon
*Attorney, Agent, or Firm*—Mallinckrodt & Mallinckrodt; Robert R. Mallinckrodt

[57] ABSTRACT

A fin protector for a windsurfing board or similar item includes two sides secured together to form a pocket or receiving space for the tip of a fin to be protected into which the tip of the fin is inserted. The fin is forced into the pocket far enough to flex the sides apart enough so that the sides press against the fin and hold the protector on the fin. One side preferably extends beyond the fin receiving opening so as to guide the bottom of the fin into the opening when the protector is placed on the fin.

15 Claims, 3 Drawing Sheets

WINDSURFING BOARD FIN PROTECTOR

BACKGROUND OF THE INVENTION

1. Field

The invention is in the field of protectors for the fins of windsurfing boards or the like.

2. State of the Art

A windsurfing board is similar to a surfboard, but with a mast and sail. A fin extends from the rearward bottom of the board. When windsurfing, it is common to keep the windsurfing board on a beach until the right conditions occur and the board is put into the water for use. After use in the water, it is again pulled onto the beach until used again in the water or taken for transportation and/or storage. When on the beach, the board usually rests on its fin, which can damage the lower edge of the fin where the board rests. As the boards and fins become more refined, even small nicks and minor damage to the edges and lower surface of the fins can have an adverse effect on the board's performance. It is therefore desirable to protect the fins during transportation and storage and during the time a board is set on a beach waiting for use or between uses.

Currently available fin protectors are made of a soft EVA foam or similar material which fits over a fin to protect it. With a soft material, when the board is set down with the fin on a beach or other hard surface, damage can still occur through the soft foam material. Further, the foam material wears through relatively quickly at the bottom of the fin leaving the bottom of the fin exposed to damage. In addition, the prior art fin protectors have a tendency to fall off the fin when the board is moved.

SUMMARY OF THE INVENTION

According to the invention, a fin protector is made of a semi-rigid or substantially rigid material in the form of a pocket which fits over and accepts the lower portion of the fin therein and which holds onto the fin so the pocket does not normally fall off. The pocket can be easily pulled off the fin when it is desired to use the board and replaced on the fin when the board is brought out of the water and placed on the beach or otherwise transported or stored.

The pocket is preferably formed of a plastic material which is soft enough to flex and go over, but not damage, the fin, yet rigid enough that it will grip and normally stay on the fin once placed thereon. A low density polyethylene or a fiber filled polyvinyl-chloride has been found satisfactory. The pocket may be formed from two sheets of suitable material cut to a pocket shape and secured together along their edges. This can be done by gluing, riveting, stapling, sewing, or similarly securing the pieces together or a combination of the above. The pocket can also be injection molded. The top of the pocket is partially open so that the fin can be inserted into the pocket between the sheets of material and it is preferred that the material along one side of the top of the pocket extend above the other side and the opening to guide a fin tip into the opening to more easily enable insertion of the fin into the pocket.

THE DRAWINGS

The best mode presently contemplated for carrying out the invention is illustrated in the accompanying drawings, in which:

FIG. 1 is a pictorial and somewhat schematic representation of a windsurfing board showing a bottom fin to be protected;

FIG. 2, a side elevation of a windsurfing board fin such as taken on the line 2—2 of FIG. 1, but not showing the board, and showing the fin protector of the invention in place thereon;

FIG. 3, a vertical section through the fin and fin protector taken on the line 3—3 of FIG. 2;

FIG. 4, a pictorial view of an injection molded embodiment of the fin protector;

FIG. 5, a pictorial view of an embodiment of the fin protector including two sheets of material secured together;

FIG. 6, a pictorial view of another embodiment of the fin protector including two sheets of material secured together;

FIG. 7, a horizontal section taken on the line 7—7 of FIG. 4;

FIG. 8, a horizontal section taken on the line 8—8 of FIG. 5;

FIG. 9, a horizontal section taken on the line 9—9 of FIG. 6;

FIG. 10, a pictorial view of another embodiment of fin protector; and

FIG. 11, an enlarged vertical section taken on the line 11—11 of FIG. 10 with an intermediate portion thereof broken away.

DETAILED DESCRIPTION OF THE ILLUSTRATED EMBODIMENTS

Figures 1, 2:
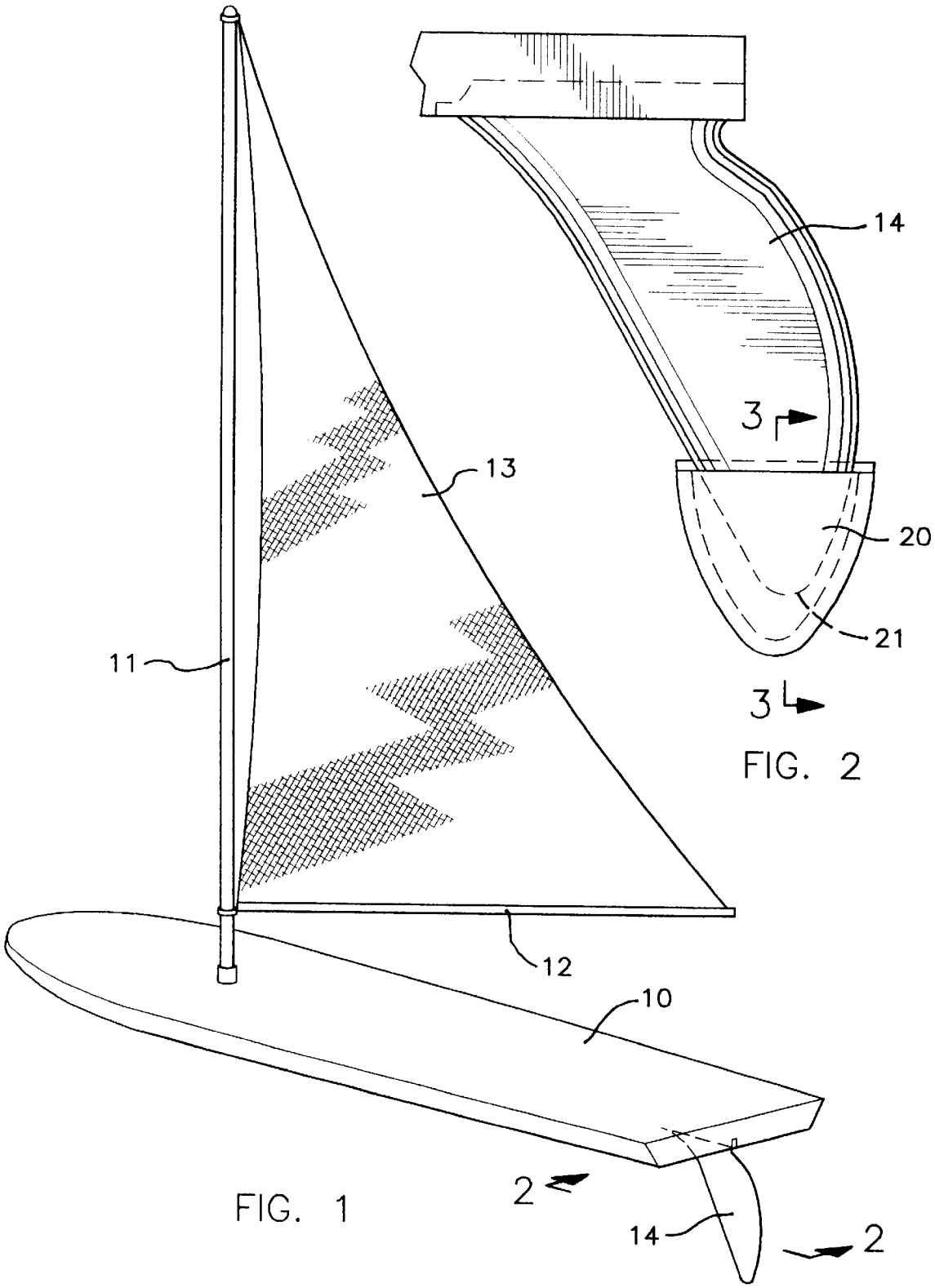
Figure 4:
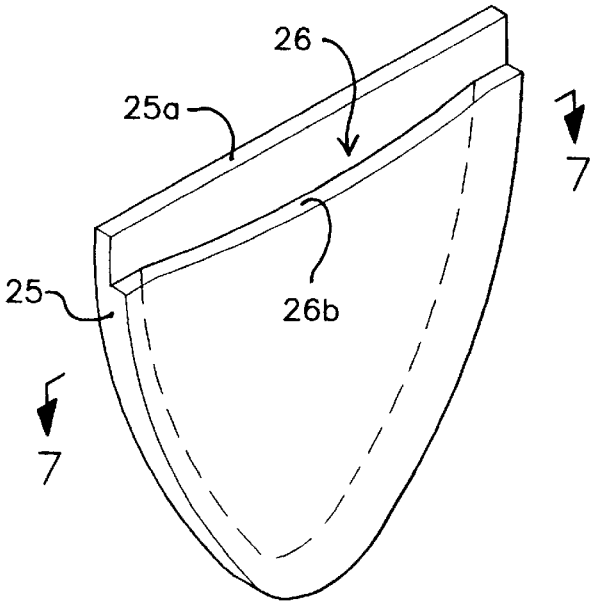

Windsurfing boards generally consist basically of a board 10, FIG. 1, similar to a surf board, with a mast 11 and boom 12 mounting a sail 13. The board 10 has a stabilizing fin 14 extending from the rearward bottom of the board.

In use, it is normal practice for a person windsurfing to put the board down on the beach with the bottom of the fin resting on the beach to support the rear end of the board while waiting for the right windsurfing conditions or while resting. Also, in storage or in transporting the board, the board can be put down to rest on its fin. While putting the fin down on a sandy beach may not damage the fin, if rocks are present or the board is put down on a hard surface, damage to the fin edge can result. It is thus desirable in most instances to protect the fin when it is resting on a surface.

The present invention provides a fin protector 20, FIG. 2, in the form of a pocket which fits over the bottom portion of fin 14. The protector 20 is made of a semirigid or substantially rigid material the bottom of which will rest on a supporting surface and separate and hold the bottom of the fin 21 above and off the surface, thus protecting the bottom 21 of the fin 14. Any semirigid or substantially rigid material may be used for the protector, but the material must flex to the extent that it will separate and flex as the fin is inserted into the pocket. It must be rigid enough so that when the fin is inserted into the pocket, the material grips the fin and holds the pocket on the fin so it does not fall off. Further, the material must be soft enough so that upon insertion of the fin, it does not scratch or damage the fin, but rigid enough that it supports and separates the bottom of the fin from a resting surface. A low density polyethylene material or a fiber filled polyvinylchloride (PVC) material has been found satisfactory.

Figure 3:
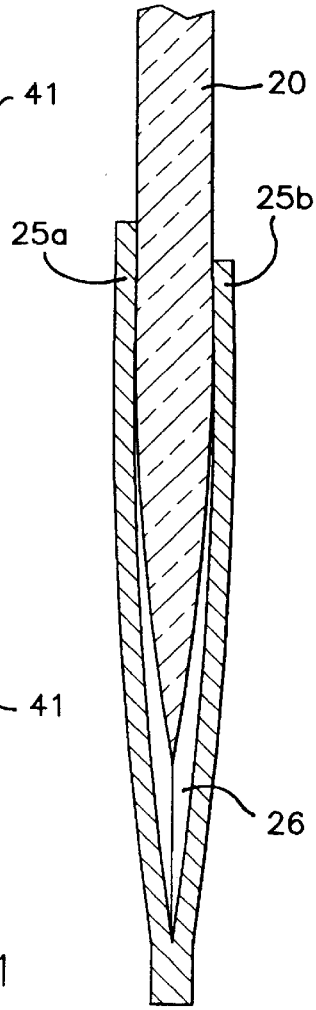

The fin protector may be injection molded to a form 25 as shown in FIGS. 2, 3, 4 and 7 with protector sides 25*a* and 25*b* forming an inner fin receiving pocket opening 26 into which the fin is inserted. The pocket opening 26 may be formed with some open area shown as 26 into which the bottom of the fin can be initially inserted. However, the opening, i.e., the space between sides 25*a* and 25*b*, is normally narrower than the thickness of the fin. The protector is then pushed onto the fin so the fin extends further into the pocket which causes the opposite sides 25*a* and 25*b* of the protector to flex and fractionally engage the fin side surfaces as shown in FIG. 3 to hold the protector on the fin. It is preferred that one side of the protector, shown as 25*a* in FIGS. 3 and 4, extend further than the other side, i.e., extend beyond the opening 26, to form a wall to help line up the protector with the fin and guide the fin into pocket opening 26. As shown in FIG. 3, the protector will hold and support a fin above a surface with the protector sides transmitting supporting forces to the fin sides while relieving supporting force from the fin tip edge.

Figure 5:
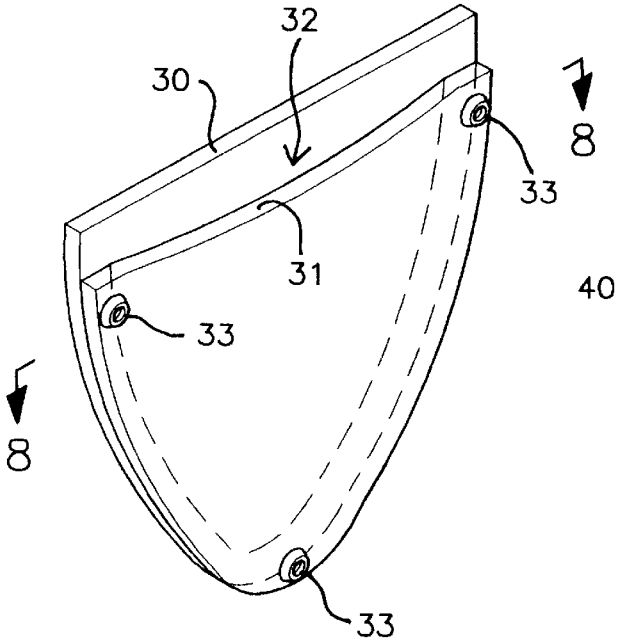
Figure 8:
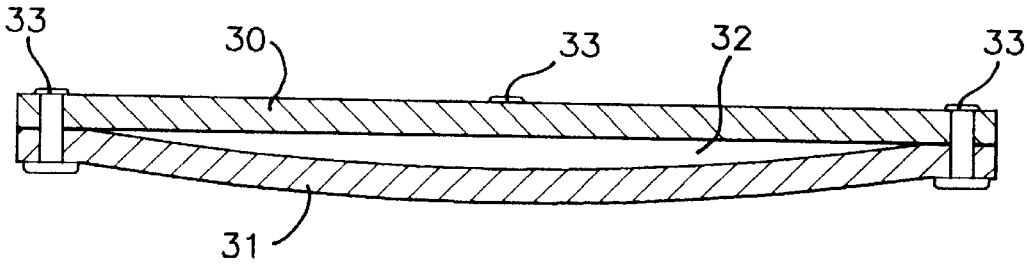

The protector may also conveniently be made of two pieces of material, such as polyethylene sheet material, cut to shape, and joined along its edges. One-eighth inch thick polyethylene sheet material has been found satisfactory. The pieces may be joined along sections of their circumferential edge portions in any satisfactory manner such as by gluing, rivets, sewing, stapling, etc. With polyethylene material which is difficult to glue, it is preferred that the pieces be mechanically held together as well as glued to assist the glue. Thus, as shown in FIGS. 5 and 8, the pieces of material 30 and 31 may be glued along their edges except for the top edge having pocket opening 32 which has to remain open, and the glue is reinforced by mechanically attaching the pieces with rivets 33 at the top edges and at the bottom. Rivets could be used without glue, but in such case it is desirable to include at least two more rivets intermediate the sides.

Figure 6:
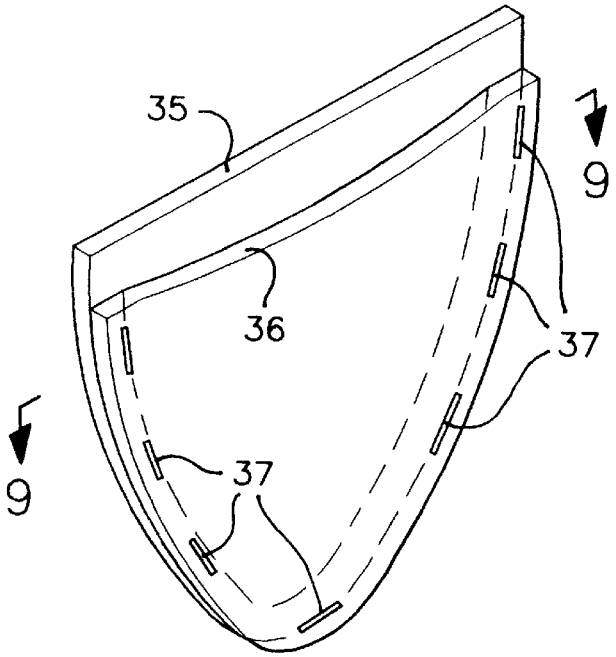
Figure 9:
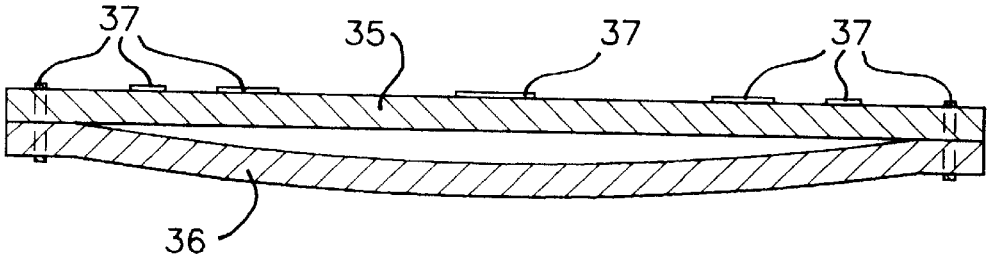

FIGS. 6 and 9 show the two pieces of material 35 and 36 secured together with staples 37.

Figure 11:
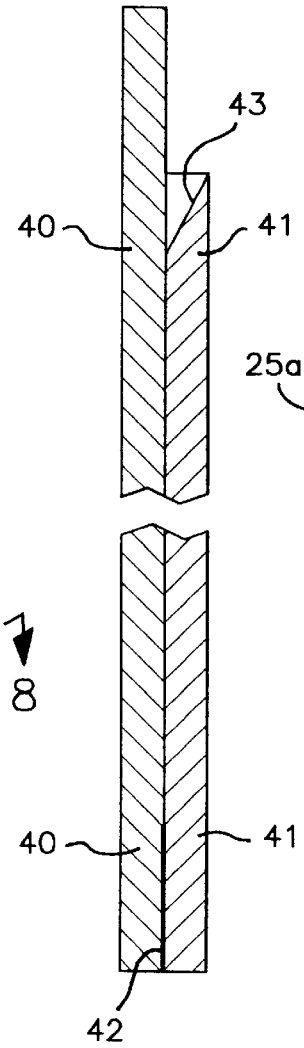
Figure 10:
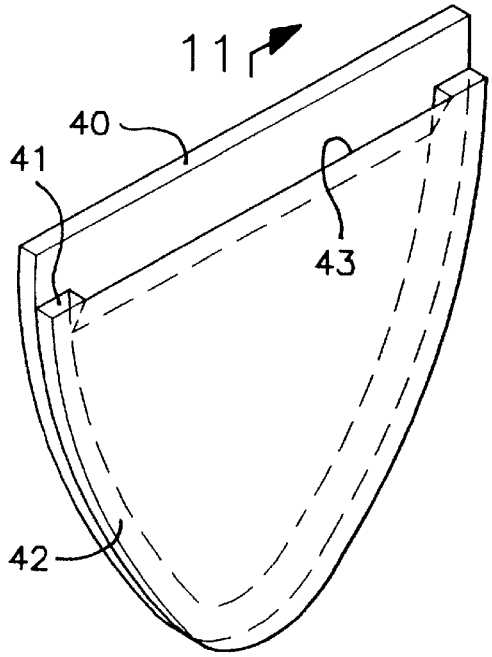
Figure 7:
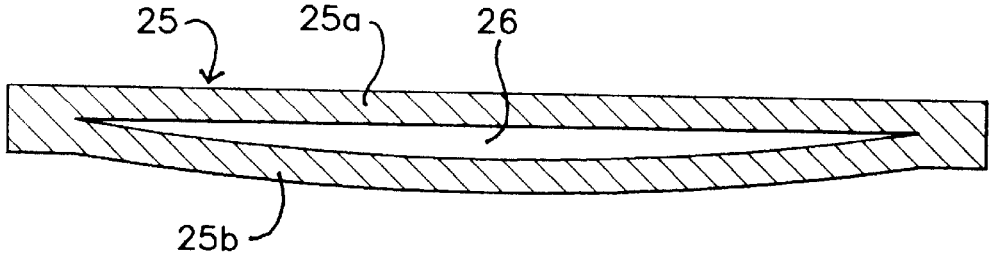

FIGS. 10 and 11 show a glued protector made of an easily glueable material such as a fiber filled polyvinychloride (PVC) material. The pieces 40 and 41 are glued about the edge portion sections 42, leaving the top section unglued and open to receive a fin tip. In the embodiment of FIGS. 10 and 11, the initial top opening shown for prior embodiments is not provided, although it could be and such opening may be formed during use of the protector, but the shorter side 41 has an inward bevel 42 at the top thereof to provide an opening to initially easily receive the bottom edge of the fin so the pocket can then be easily pushed onto the fin with the bottom of the fin extending into the area between sides 40 and 41 and being held thereon by the flexed sides squeezing the fin. One-eighth inch thick pieces of a PVC material known as CENTRA have been found satisfactory.

It should be realized that while a shape somewhat conforming to the shape of the lower portion of the fin has been used, various shapes could be used for the protector as long as the protector hangs onto a fin and supports and hold the fin tip edge above a surface.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A fin protector for protecting the fin tip edge of a fin for windsurfing boards, comprising:

a pair of protector sides secured together to form a fin tip receiving opening therebetween, said opening of a size to receive the fin tip of a windsurfing board and being narrower than the thickness of the fin so that the sides are flexed as the fin is inserted into the fin receiving opening to an extent to clamp and hold the fin tip protector on the fin, the protector material being rigid enough to support and hold the fin tip above the surface upon which the protector may rest and without supporting force being to the fin tip edge and with the protector held solely on the fin.

2. A fin protector according to claim 1, wherein the fin has fin sides and wherein the protector sides transmit supporting force to the fin sides.

3. A fin protector according to claim 2, wherein the protector sides have circumferential edges and circumferential edge portions along and adjacent to the edges, and wherein the protector sides are secured together along sections of their respective circumferential edge portions.

4. A fin protector according to claim 3, wherein one protector side extends beyond the opening to guide the fin tip into the opening.

5. A fin protector according to claim 4, wherein the opening includes an initial partial opening to initially receive the fin tip prior to flexing of the sides.

6. A fin protector according to claim 5, wherein the sides are spaced to form the opening.

7. A fin protector according to claim 5, wherein the edge of the wall adjacent the opening is beveled inwardly to form the opening.

8. A fin protector according to claim 1, wherein the protector is injection molded and the sides are secured together by being molded together.

9. A fin protector according to claim 1, wherein the sides are secured together by gluing.

10. A fin protector according to claim 1, wherein the sides are stapled together.

11. A fin protector according to claim 1, wherein the sides are riveted together.

12. A fin protector according to claim 1, wherein the opening includes an initial partial opening to initially receive the fin tip prior to flexing of the sides.

13. A fin protector according to claim 12, wherein the sides are spaced to form the opening.

14. A fin protector according to claim 12, wherein the edge of the wall adjacent the opening is beveled inwardly to form the opening.

15. A fin protector according to claim 1, wherein one protector side extends beyond the opening to guide the fin tip into the opening.

* * * * *